United States Patent [19]

Davies et al.

[11] Patent Number: 4,665,593

[45] Date of Patent: May 19, 1987

[54] CLAMP FOR ELONGATE MEMBERS

[75] Inventors: Colin M. Davies, Sheffield; William Hamilton, Hexham, both of England

[73] Assignee: British Steel Corporation, England

[21] Appl. No.: 777,822

[22] Filed: Sep. 19, 1985

[30] Foreign Application Priority Data

Nov. 2, 1984 [GB] United Kingdom ..... 8427833

[51] Int. Cl.[4] ..... A44B 21/00

[52] U.S. Cl. ..... 24/459; 24/457; 248/74.4; 248/55

[58] Field of Search ..... 24/459, 457; 248/55, 248/74.4, 62

[56] References Cited

U.S. PATENT DOCUMENTS

| | | | |
|---|---|---|---|
| 2,106,956 | 2/1938 | Nakamura | 248/55 X |
| 3,516,630 | 6/1970 | Janssens | 248/55 |
| 4,222,538 | 9/1980 | Jensen et al. | 248/74.4 X |

FOREIGN PATENT DOCUMENTS

| | | | |
|---|---|---|---|
| 1007270 | 5/1957 | Fed. Rep. of Germany . | |
| 1054401 | 4/1959 | Fed. Rep. of Germany . | |
| 1118717 | 12/1961 | Fed. Rep. of Germany . | |
| 1152981 | 8/1963 | Fed. Rep. of Germany . | |
| 2740064 | 6/1979 | Fed. Rep. of Germany . | |
| 3215494 | 10/1983 | Fed. Rep. of Germany | 248/62 |
| 7928626 | 11/1979 | France . | |

*Primary Examiner*—Kenneth J. Dorner
*Assistant Examiner*—Laurie K. Cranmer
*Attorney, Agent, or Firm*—Andrus, Sceales, Starke & Sawall

[57] ABSTRACT

A clamp for joining together overlapping sections of elongate members in, for example, telescopic steel arches used in the mining industry comprises a frontal plate and a U-bolt, the arms of the U-bolt being inclined to a line drawn normal to a load bearing surface of the frontal plate at a preferred angle of between 5° and 40°.

8 Claims, 4 Drawing Figures

$F_\tau/F_{CL}$

·25
·20
·15
·10
·05
0
-·05
-·10
-·15
5
10
15
20
25
30
35
40
θ°
$C_{mf}=1.0$
$C_{mf}=0$
μ=1·0
μ=0·75
μ=0·50

CLAMP FOR ELONGATE MEMBERS

This invention relates to clamps. More especially, the invention concerns clamps for joining together overlapping sections of elongate members between which relative sliding movement occurs.

Telescopic steel arches comprising two or more beams of standard TH-section have been used as underground roadway supports by the mining industry for some considerable time. The arches are designed to withstand increased strata pressures and eccentric loading resulting from exploitation at greater depths in coal, potash and other ore mines and are constructed by clamping overlapping lengths of arch beams together such that convergence of the arch can occur through relative sliding movement between the individual beams. By "convergence" is meant a reduction in the overall length of the telescopic steel arch caused by relative sliding movement between the individual beams from which the arch is constructed. Distortion of the components of the arch is therefore, in theory, precluded by this permitted sliding movement.

Various designs of clamp for telescopic steel arches are known. One such clamp consists of a frontal plate and a co-operating mild steel U-bolt which is drawn towards the frontal plate to grip beams embraced by the clamp. In this known clamp, the tensile forces acting along the bolt arms lie in a direction normal to the beam surfaces. Although cheap to manufacture, such clamps suffer from the disadvantage that they tend to tilt as convergence of the arch beams takes place. They require, therefore, frequent attention after installation to correct their alignment with respect to the beam surfaces.

These known clamps suffer from the additional disadvantage that in service the attainment of a satisfactory convergence load is sometimes accompanied by bending of the bolts, making the clamps unserviceable and resulting in discontinuous load versus convergence behaviour. That is to say the designed relationship between the load applied and the convergence of the arch members embraced by a clamp is disrupted because of the resistance to convergence imposed by bending of the bolts. It has also been observed that these known clamps can become vulnerable to such damage if attempts are made to obtain high convergence loads using beam lengths of less than perfect fit.

Other more elaborate designs of clamp are known. These do not, however, offer the combined advantages of simplicity, ease of assembly and servicing, and low cost present in conventional U-bolt clamps.

According to the present invention in one aspect, there is provided a clamp comprising a frontal plate and a U-bolt in which the arms of the U-bolt are inclined to a line drawn normal to a load bearing surface of the frontal plate.

The arms may each be inclined at an angle of between 5° and 40° to a line drawn normal to the aforesaid bearing surface.

According to the present invention in another aspect, there is provided a clamp comprising an assembly of a frontal plate and a U-bolt wherein, in use of the clamp, the tensile forces present within the arms of the U-bolt act in a direction which is inclined to a line drawn normal to one or more load bearing surfaces of the frontal plate. Preferably, the tensile forces act in a direction which is inclined at an angle of between 5° and 40° to a line drawn normal to the load bearing surface(s).

According to the present invention in a still further aspect, there is provided a clamp for joining together overlapping lengths of two or more elongate members between which relative sliding movement is to be accommodated, the clamp comprising an assembly of a frontal plate and a U-bolt and including bearing surfaces through which, in use, clamping forces are applied to members embraced by the clamp, the arrangement being such that the tensile forces which act through the arms of the U-bolt do so in a direction which is inclined to a line drawn normal to one or more bearing surfaces of the clamp. In a preferred arrangement, the tensile forces act in a direction which is inclined at an angle of between 5° and 40° to a line drawn normal to bearing surface(s) of the clamp.

The angle of inclination referred to in the preceding four paragraphs may advantageously lie in the range 10° to 30° or the range 15° to 25°.

In one arrangement, the frontal plate of the clamp includes outwardly extending brackets formed with apertures through which threaded ends of the arms of the U-bolt can pass to enable the U-bolt to be assembled to the frontal plate; in this arrangement the load bearing surface of each bracket is preferably inclined at an angle of between 5° and 40° to the bearing surface or surfaces of the frontal plate.

The frontal plate is preferably U-shaped in section and is so constructed that the clamping force is transmitted between longitudinal bearing surfaces located at the free ends of the plate and the bridge portion of the U-bolt. The frontal plate and/or the U-bolt are preferably manufactured from steel.

The invention will now be described by way of example only, with reference to the accompanying diagrammatic drawings in which.

Figure 1:
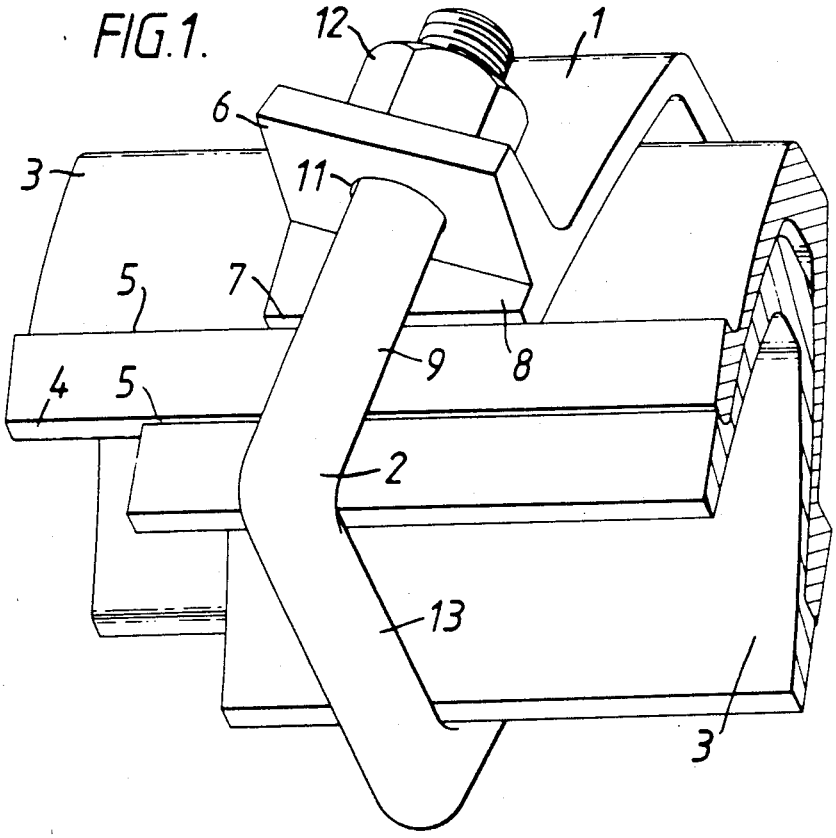
FIG. 1 is a perspective view of a clamp in accordance with the invention.

FIG. 1 illustrates a clamp in accordance with the present invention when in use for joining conventional TH-section beams of a telescopic steel arch is used in the mining industry. Telescopic arches are employed to provide underground roadway supports and must be capable of withstanding variations in strata pressures and eccentric loading resulting from exploitation of a mine's resources at different levels. In telescopic arches, such increases are accommodated through convergence of the arch itself. Thus, the clamps joining the overlapping beam sections must in addition to providing the required firm connection between the overlapping sections, also permit some relative sliding movement in response to increases in the strata pressures and loadings.

The clamp illustrated in FIG. 1 comprises an assembly of a steel frontal plate 1 and U-bolts 2; the beams 3 are generally of "U" shaped construction, their overlapping lengths nestling one with the other with the lower longitudinal edges 4 of the upper beam resting against longitudinal bearing surfaces 5 of the lower beam. The upper beam also includes bearing surfaces 5.

The frontal plate 1 of the clamp is formed with outwardly extending brackets 6 each set at an angle of approximately 15° to the plate's load bearing surfaces 7 which extend along the free edges of the clamp ends 8 which protrude below the brackets 6. The bearing surfaces 7 lie in contact with the longitudinal bearing surfaces 5 of the uppermost beam 3.

The arms 9 of the U-bolt are threaded and, on assembly of the clamp, protrude through apertures 11 formed in the brackets 6. Nuts 12 co-operate with the threaded ends of the arms 9 to secure the U-bolt 2 to the frontal plate 1.

In use, the frontal plate 1 seats on the upper beam with its bearing surfaces 7 in contact with the respective bearing surfaces 5 of the beam. The U-bolt 2 is then assembled and drawn towards the frontal plate by tightening of the nuts 12. Clamping forces are applied to the overlapping beam lengths through the bearing surfaces 7 of the frontal plate 1 and the bridge section 13 of the U-bolt.

Because the upper surface of each bracket 6 is inclined at an angle of 15° with respect to the bearing surfaces 7, the tensile forces acting through the arms 9 of the U-bolt are inclined at the same angle to a line drawn normal to the bearing surfaces.

Figure 2:
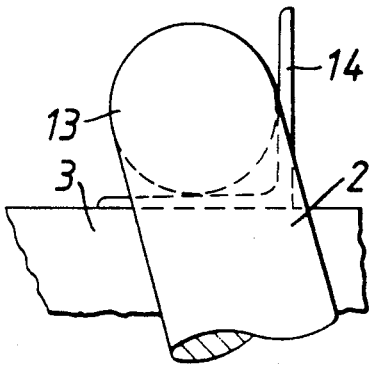
FIG. 2 illustrates an angled forging provided to assist seating of one part of a clamp assembly in accordance with the invention with respect to one beam embraced by the clamp.

The contact pressure between the bridge section 13 of the U-bolt and the adjacent beam 2 may be reduced by means of a forged steel member 14 capable of spreading the load applied by the clamp to the beam. As shown in FIG. 2, the member may comprise a simple angled forging 14 formed with a groove to assist its seating with respect to the beam. However, any member capable of performing the required function may be employed, such members including a captive shoe permanently attached to the U-bolt 2. Alternatively or additionally, the underside of the bridge section 13 of the U-bolt may be formed with one or more flat surfaces to achieve a similar objective.

The clamp body may be fabricated by, for example, welding together steel components or by machining an appropriate rolled steel section. Alternatively, the clamp body may be cast from, for example steel or SG iron.

The bridge section of the U-bolt may be located in a notch formed in one of the beams, with convergence causing sliding of the clamp body along the other beam. Alternatively, the U-bolt may be anchored within holes formed in an angled member which seats on the free end of the uppermost beam with one side projecting downwardly over the free end of the beam.

Figure 3:
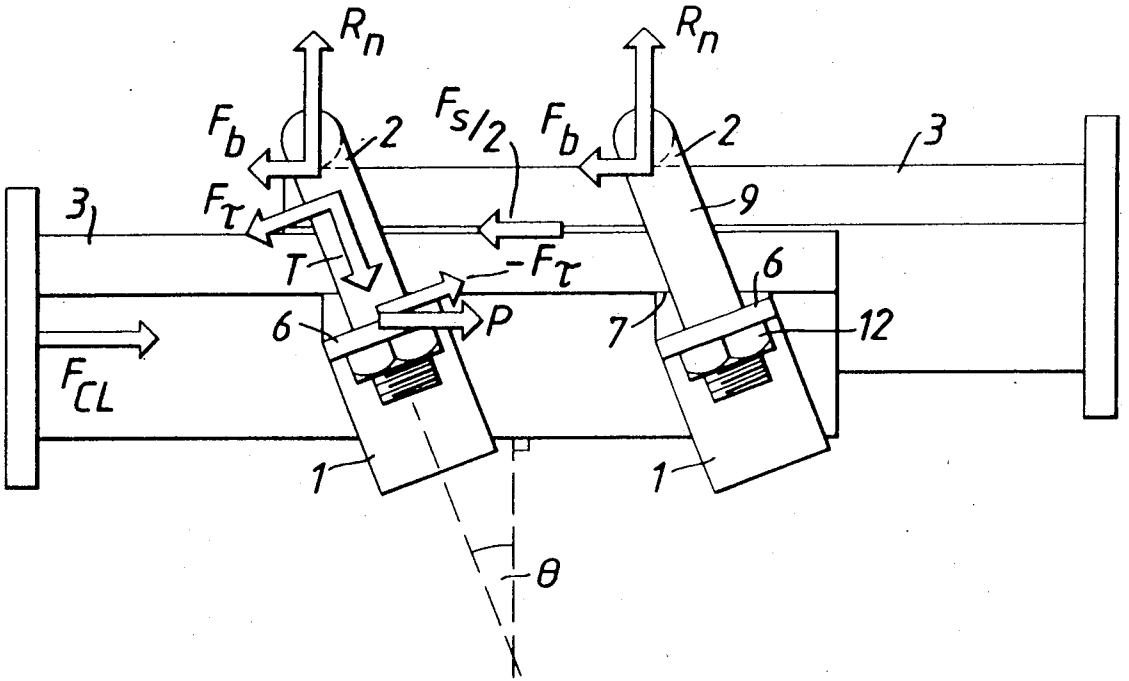
FIG. 3 is a side view of clamps in accordance with the invention when in use in a telescopic steel arch and illustrates the forces acting on the clamps during use thereof.

The forces acting at each contact point in a converging joint using two clamps in accordance with the invention are illustrated in FIG. 3. Tension is introduced into each bolt by tightening the nuts 12 to produce a normal reaction $R_n$ at each point of contact between the clamps and the beam 3. The total reaction at each point of contact is the sum of the normal reaction $R_n$ and the frictional force $F_b$. The load $F_{CL}$ required to produce convergence of the arch is equal to the sum of the frictional forces $F_b$ at each clamp and the frictional force $F_s$ generated between the overlapping beams 3.

Thus, $$F_{CL} = 4F_b + F_s \quad (1)$$

$$= 4T\mu_s + 4T\mu_b \quad (2)$$

where $\mu_s$ and $\mu_b$ are the appropriate coefficients of friction and T is the tension in the U-bolt 2 under conditions of sliding.

The forces acting on the U-bolt 2 can be resolved into the tensile force T acting along the bolt arms and bending force $F_\tau$ acting perpendicular to the bolt.

Resolving parallel to the beams 3, $$F_b = -(T \sin\theta + P) \quad (3)$$

(where $\theta$ is the angle of inclination of the U-bolt arms to the bearing surfaces 7 and P is the applied convergence force);

resolving perpendicular to the beams 3

$$R_n = -T\cos\theta \quad (4)$$

Since $F_b = \mu_b \cdot R_n$, $$-(T\sin\theta + P) = -\mu_b \cdot T\cos\theta \quad (5)$$

Now $$F = P\cos\theta \quad (6)$$

$$= T\cos\theta\,(\sin\theta - \mu_b\cos\theta)$$

If the overlapping beam lengths do not fit perfectly, contact may initially occur between the inclined walls of the TH sections and the component of the reaction normal to the contacting bearing surfaces 5, 6 is therefore minimised. These effects can be accounted for by the introduction of a factor $C_{mf}$ which takes into account any misfit which may occur such that $$F_s = 4TC_{mf}\mu \quad (7)$$

Hence $$\frac{F_b}{F_{CL}} = \frac{\mu_b}{4(C_{mf}\mu_s + \mu_b} \quad (8)$$

It can be seen that as the degree of mis-fit increases $C_{mf}$ tends towards zero and the bending force for a given convergence load increases. This situation can very rapidly lead to bolt distortion.

From equation (1) above, $$F_{CL} = 4F_b + F_s \quad (9)$$

$$= -4_{\mu b} \cdot T\cos\theta + (-4_{\mu s}C_{mf}\cos\theta)$$

$$= -4T\cos\theta\,(\mu_b + C_{mf}\mu_s)$$

Therefore $$\frac{F_\tau}{F_{CL}} = \frac{-T\cos\theta\,(\sin\theta - \mu_b\cos\theta)}{4T\cos\theta\,(\mu_b + C_{mf}\mu_s)} \quad (10)$$

$$= \frac{\mu_b\cos\theta - \sin\theta}{4(\mu_b + C_{mf}\mu_s)}$$

Figure 4:
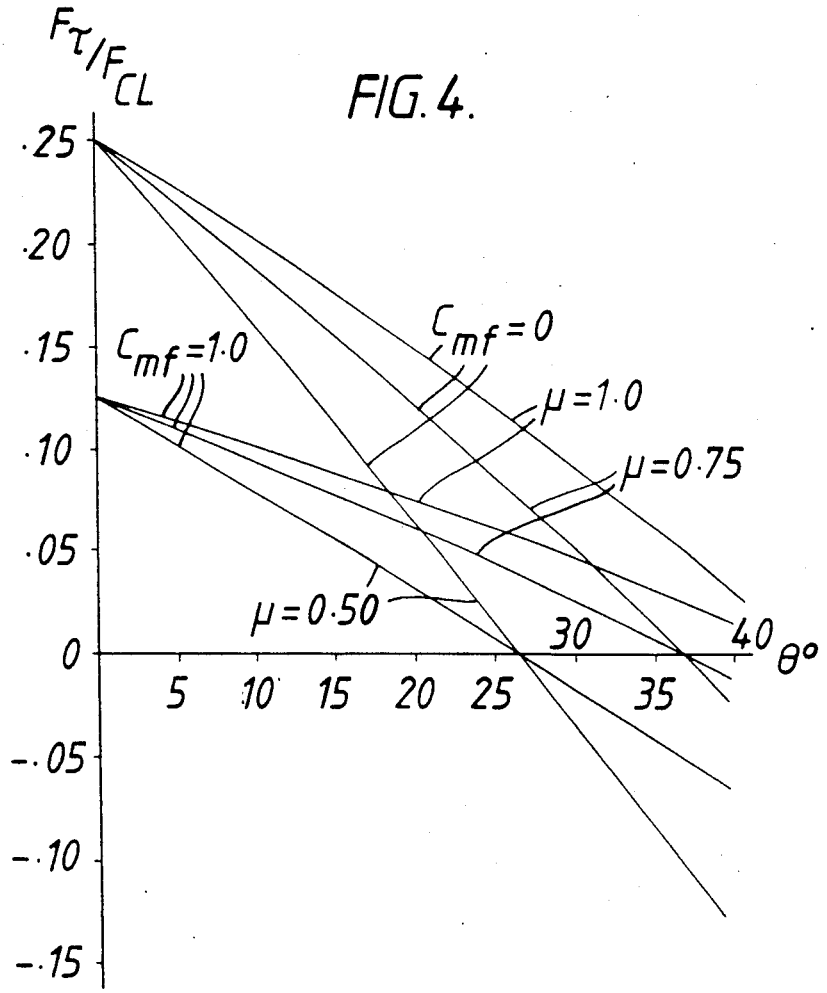
FIG. 4 graphically illustrates the relationship existing between various parameters of the clamps in use thereof.

For the case where $\theta = 0°$ (i.e. in the case of conventional U-bolt clamps), $F_\tau = F_b$ and equation (10) reduces to equation (8); however, as $\theta$ increases towards $\theta = \tan^{-1}\mu_b$, the value $F_T/F_{CL}$ decreases towards zero. The situation is illustrated in FIG. 4 where $F_T/F_{CL}$ is plotted against $\theta$. For simplicity it is assumed that $\mu_b = \mu_s$ and lines are drawn for three values of $\mu(\mu = 0.50, 0.75, 1.0)$ and for the two extreme values of $C_{mf}$. From FIG. 4 it can be seen that the bolt bending force as a proportion of convergence load decreases as the angle of inclination increases. More significantly, the influence of the coefficient $C_{mf}$ on bolt bending decreases as the angle of inclination approaches the angle of friction. It will be appreciated, therefore, that there are clear advantages to be gained by employing clamps in which the tensile forces acting through the U-bolt arms are inclined to the normal loading line. These advantages have, of course, to be matched with practical difficulties associated with large angles of inclination, such as the increase in bolt torque that would be required for the same convergence load.

It has been established through experimentation that the angle of inclination should preferably lie in the range 5° to 40° to the normal to the loading line. Within this broad range, it has been found that advantages accrue with angles of inclination within the range 10° to 30° and within the range 15° to 25° to the normal to the loading line.

It is to be understood that the foregoing description is merely exemplary of clamps in accordance with the invention and that modifications may be made to the clamps illustrated and described without departing from the true scope of the invention. Thus, the wing-type brackets 6 illustrated may be replaced by solid brackets which extend in depth to the edges of the bearing surfaces 7. Furthermore, whereas as shown in FIG. 1 of the drawings the clamp ends 8 are formed integral with the clamp, in an unillustrated alternative arrangement, the clamp ends 8 are replaced by separable wedge members disposed between the free ends of the clamp and the bearing surfaces 5 of the uppermost beam length.

We claim:

1. An assembly of a clamp and at least two elongate members which are embraced by the clamp and between which relative sliding movement in a lengthwise direction of the elongate members is to be accommodated; at least a first of the elongate members being formed with at least one lengthwise extending load-bearing surface which extends generally in the direction of the aforesaid relative movement between the elongate members; the clamp including a U-shaped bolt formed with two generally parellel arms joined by an intermediate bridge section in contact with a second of the elongate members and a saddle-shaped frontal plate formed with at least one lengthwise extending load-bearing surface which seats upon and extends generally in the direction of the load-bearing surface of the aforesaid first elongate member; the frontal plate including two outwardly extending planar flange members, each flange member disposed at an acute angle with respect to the load-bearing surface of the first elongate member to which one of the arms of the U-bolt is secured such that the arms of the U-bolt are each inclined at a common acute angle with respect to a line drawn normal to the aforesaid load-bearing surfaces and to the aforesaid direction of relative movement between the elongate members.

2. An assembly as claimed in claim 1 wherein the arms of the U-bolt are inclined at an angle of between 5° and 40° to a line drawn normal to the aforesaid load-bearing surfaces.

3. An assembly as claimed in claim 1 wherein the arms of the U-bolt are each inclined at an angle of between 10° and 30° to a line drawn normal to the aforesaid load-bearing surfaces.

4. An assembly as claimed in claim 1 wherein the arms of the U-bolt are each inclined at an angle of between 15° and 25° to a line drawn normal to the aforesaid load-bearing surfaces.

5. A clamp for embracing and joining together at least two elongate members between which relative sliding movement in a lengthwise direction of the members is to be accommodated; the clamp including a U-shaped bolt formed with two generally parallel arms joined by a intermediate bridge-portion and a saddle-shaped frontal plate formed with at least one longitudinal load-bearing surface and two outwardly extending planar flanges, each flange disposed at an acute angle with respect to the load-bearing surface to which one of the arms of the U-bolt is to be secured such that the arms of the U-bolt are each inclined at a common acute angle to a line drawn normal to the aforesaid load-bearing surface.

6. A clamp as claimed in claim 5 wherein the arms of the U-bolt are each inclined at an angle of between 5° and 40° to a line drawn normal to the aforesaid load-bearing surface.

7. A clamp as claimed in claim 5 wherein the arms of the U-bolt are each inclined at an angle of between 10° and 30° to a line drawn normal to the aforesaid load-bearing surface.

8. A clamp as claimed in claim 5 wherein the arms of the U-bolt are each inclined at an angle of between 15° and 25° to a line drawn normal to the aforesaid load-bearing surface.

* * * * *